US011768061B2

(12) United States Patent
Rathborn

(10) Patent No.: US 11,768,061 B2
(45) Date of Patent: Sep. 26, 2023

(54) FLETCHING DEVICE

(71) Applicant: Laurent Rathborn, Camberley (GB)

(72) Inventor: Laurent Rathborn, Camberley (GB)

( * ) Notice: Subject to any disclaimer, the term of this patent is extended or adjusted under 35 U.S.C. 154(b) by 0 days.

(21) Appl. No.: 17/770,135

(22) PCT Filed: Oct. 12, 2020

(86) PCT No.: PCT/GB2020/052543

§ 371 (c)(1),
(2) Date: Apr. 19, 2022

(87) PCT Pub. No.: WO2021/079089

PCT Pub. Date: Apr. 29, 2021

(65) Prior Publication Data

US 2022/0390213 A1 Dec. 8, 2022

(30) Foreign Application Priority Data

Oct. 21, 2019 (GB) ..... 1915200

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS

| | | | | |
|---|---|---|---|---|
| 4,204,307 | A * | 5/1980 | Pfetzing | F42B 6/06 29/418 |
| 5,951,149 | A * | 9/1999 | Lee | G02B 27/20 362/205 |
| 7,331,886 | B2 * | 2/2008 | Morris | F42B 10/18 473/578 |
| 9,046,330 | B2 * | 6/2015 | Pedersen | F42B 6/06 |
| 9,410,776 | B1 | 8/2016 | Hill | |
| 9,863,743 | B2 * | 1/2018 | Gall | F42B 6/06 |
| 2013/0072332 | A1 | 3/2013 | Blosser et al. | |

* cited by examiner

*Primary Examiner* — John A Ricci
(74) *Attorney, Agent, or Firm* — Phillips Murrah PC; Martin G. Ozinga

(57) ABSTRACT

A fletching device (6) which is removably mountable on an arrow shaft, the fletching device comprising a body (60) which is engageable with an arrow shaft, and at least two vanes (66) attached to the body. The body is reversibly deformable such that a friction fit is provided between the body and an arrow shaft when the body is engaged with an arrow shaft. This allows the device to be easily and quickly removed and replaced on an arrow shaft.

11 Claims, 10 Drawing Sheets

FLETCHING DEVICE

The present invention relates to the field of archery, and in particular to a fletching device for arrows or other projectiles such as crossbow bolts or darts.

Figure 1A:
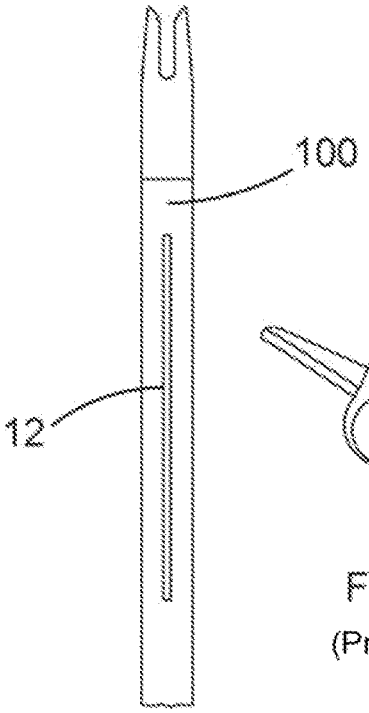
FIG.1a (Prior Art)
Figure 1B:
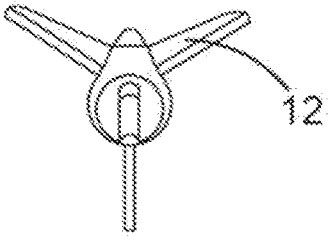
FIG.1b (Prior Art)

Fletching refers to fins which are attached to projectiles to aerodynamically stabilise their flight. A common straight fletching, as illustrated in FIGS. 1*a* and 1*b*, has vanes 12 which are glued on the arrow shaft 100 and aligned with a longitudinal axis of the shaft. A benefit of straight fletching is that almost zero arrow speed is lost due to the interaction of the vanes with air. In another type of fletching, illustrated in FIGS. 2*a* and 2*b*, vanes 22 placed at a slight angle with respect to a longitudinal axis of the arrow shaft 200. This is known as 'offset fletching'. Alternatively, as illustrated in FIGS. 3*a* and 3*b*, vanes 32 may themselves be shaped like an aerofoil, or may be straight and attached in such a way as to create an aerofoil. This is known as 'helical fletching'. This imparts a spin on the arrow as it travels through the air. The rotation acts like a gyroscope to stabilize the arrow to ensure that it does not tumble during flight. The direction of the offset or the helical shape is selected according to the handedness of the archer.

Arrows are generally provided in a ready-to-use form in which vanes are glued onto the arrow shaft. Some archers have however taken to fletching their own arrows. This allows them to customise their arrows for a particular bow or for a specific purpose. Equally, sometimes fletchings are damaged and need replacing so that the arrow shaft can still be used. It is therefore possible to purchase unfletched arrows and separate vanes for attachment to the arrow shaft.

Individual stick-on vanes made of rubber, plastic, and feathers are available. One problem with stick-on vanes is that they need to be glued or taped onto an arrow shaft one by one. The correct application of this type of vane requires some skill and can be difficult and time consuming for beginner archers. Further, it sometimes requires the use of a jig for accurate application of the vanes onto the arrow shaft. Stick-on vanes are non-reusable once they have been damaged or broken off the shaft.

A heat shrink-fit fletching device is available under the trade name QuickFletch, available from New Archery Products Inc. of Grand Prairie Tex., 75053-51890, USA. This type of fletching device is provided with a cylindrical body and vanes attached to the body. The body of this fletching device is made of a material which shrinks under the action of heat. The body is slid onto an arrow shaft and then immersed in boiling water or subjected to a stream of hot air. The boiling water or hot air jet heat shrinks the body so that it is shrunk permanently onto the arrow shaft. One problem of this fletching device is that it is inconvenient and slow to affix to an arrow as it requires the use of boiling water or hot air. This limits the places where an archer can assemble the fletching device. Furthermore, once it has been shrunk on the arrow shaft it is not reusable. If a vane is damaged, the whole sleeve must be peeled off the shaft and a new device must be fitted.

Another fletching device is available from Advanced Archery Solutions LLC of Anderson S.C. 29623, USA, under the trade name of FOB. This device has two rigid plastic concentric sleeves which are connected by three vanes which radially extend from the inner sleeve towards the outer sleeve. During assembly, a nock end piece is removed from the un-fletched shaft. The inner sleeve is then slid onto the arrow shaft. The nock end piece is then replaced onto the end of the arrow shaft to retain the fletching device on the shaft. This fletching device requires a removable nock end piece to keep the fletching device in position. It also only works with one specific arrow shaft diameter. Further, because of its circular shape, this fletching device cannot be used with all types of bows, for example recurve bows.

One type of arrow is designed for Live-Action-Role-Playing (LARP) games. These arrows are designed for low speed, low distance flight. They are provided with a foam stopper where the point of a normal arrow would be to deaden the impact when the arrow hits its target. They are provided with a fletching made from a single piece of moulded rubber which is permanently attached to the arrow shaft.

It is amongst the objects of the invention to provide a fletching device that addresses at least some of the drawbacks of the prior art.

According to a first aspect of the invention there is provided a fletching device which is removably mountable on an arrow shaft, the fletching device comprising:

a body which is engageable with an arrow shaft, and at least two vanes attached to the body.

The body may be reversibly deformable such that a friction fit is provided between the body and an arrow shaft when the body is engaged with an arrow shaft.

According to second aspect of the invention there is provided a fletching device which is removably mountable on an arrow shaft, the fletching device comprising:

a body which is engageable with an arrow shaft, and at least two mounting means, wherein each mounting means is adapted to couple a vane to the body.

The body may be reversibly deformable such that a friction fit is provided between the body and an arrow shaft when the body is engaged with an arrow shaft.

According to a third aspect of the invention there is provided a kit comprising a fletching device as described herein and at least two vanes.

Such arrangements enable a user to quickly and simply assemble, remove, repair and/or replace a damaged fletching. They can also be used to quickly change the type of fletching. Having a body that is reversibly deformable to provide a friction fit allows mounting on arrows without the aid of glue, tape or any other further component that can eventually be lost. This enables an archer to change or repair their fletching without the need for specialist tools or materials.

The fact that the body is deformable also means that the fletching device can be used with arrows having different diameters. This means that the fletching is more versatile.

The reversibly deformable nature allows the fletching device to return to its initial shape when disengaged from a particular arrow shaft. This has the advantage that the fletching device is usable multiple times after a first use.

Where the term 'arrow' is referred to herein, the term is intended to cover projectiles which could also be considered as arrows, such as crossbow bolts or darts, or the like.

The body of the fletching device can be made in one piece with the vanes. For example, the body and the vanes can be produced together by injection moulding. In embodiments where no vanes are present or in kits according to the invention, the device may also be produced by injection moulding, optionally as a single piece. This provides a fletching device which is ready-to-use and that ensure consistency in fletching.

The fletching device may be provided with mounting means that are adapted to couple vanes to the body. This embodiment also ensures consistency since the positions of the vanes are predetermined by the position of the mounting means. This embodiment provides a further degree of flexibility since the user can couple the body with vanes of different shapes provided in a kit depending on specific requirements. Furthermore, damaged vanes can be easily removed and replaced.

The mounting means may comprise a groove extending on an outer surface of the body. The groove can extend along the body in all its length or partially. The groove can be shaped so that a corresponding interlocking portion of a vane can snap-fit into the groove. According to another embodiment, the groove is shaped so that the corresponding interlocking portion of the vane can slide into the groove. The groove can also have a tapered shape. The tapered shape may have a wider cross section towards a forward facing side of the device.

The body of fletching device may be removably mountable on at least two different arrow shaft diameters.

In some embodiments, the body of the fletching device is mountable on shaft diameters of 4.5 mm to 9.3 mm.

The body of the fletching device may be slidably mountable on the arrow shaft.

The body can comprise at least two discrete contact points which are adapted to provide the friction fit between the body and the arrow shaft. Preferably, the body comprises three or four contact points. The contact points can be provided by a portion of an inner surface of the body which directly touches the arrow shaft when the fletching device is mounted on the shaft. The contact points can also be formed by a protrusion which extends inwardly from an inner surface of the body.

The body can comprise at least two adjoined ribs. The ribs may be reversibly deformable. The ribs may be pre-stressed. This improves the friction fit by providing a higher clamping force. Preferably, the body comprises three, four, or six ribs. The ribs can be moulded together or can be subsequently assembled to form the body of the fletching device.

One of more of the ribs may be curved. The curved shaped rib has the advantage of providing contact points adapted to provide the friction fit between the body and the arrow shaft. The body may comprise at least one protrusion which extends inwardly from an inner surface of the body to assist in providing the friction fit between the body and an arrow shaft. In embodiments which comprise ribs, the at least one protrusion may be part of, or connected to a rib.

According to one embodiment, the body comprises a rib which has a cross-section having a constant thickness. According to another embodiment, the body comprises a rib which has a non-constant thickness. Preferably the rib is thicker in its central portion than at its ending portions. This can provide desired resilience to deformability and can influence the shape which the rib adopts when the body is engaged with an arrow shaft.

Two adjoined ribs may define an air channel when the body is engaged with an arrow shaft. Preferably, the fletching device is provided with two, and preferably three, air channels for stabilising the flight of an arrow. These air channels may be formed by ribs of the device.

Preferably a cross-section of the device with respect of a longitudinal axis of the body has a rotational symmetry of order 3. This provides a stable fletching.

Vanes may have a profile which is symmetric with respect to a plane perpendicular to the length of the vane. Vanes may be offset with respect to a longitudinal axis of the body or have an helical shape. The combination of a symmetric shape of the vane with an offset arrangement or helical shape has the advantage that the fletching device can be used by right handed archers when the fletching device is mounted on the arrow shaft in a first orientation, and by left handed archers when the fletching device is turned 180 degrees with respect of the first orientation and mounted on an arrow shaft.

The vanes may have a length that is longer than the length of the body. The vanes may also comprise portions which protrude radially inwards relative to the space occupied by an arrow shaft when one is engaged with the device, towards a longitudinal axis of the body. The protruding portions may serve as end mounting stop.

The body preferably comprises a polymer such as plastic, a rubber or a carbon fiber reinforced polymer.

The body and the vanes may comprise the same material or different materials.

According to a further aspect of the present invention, there is provided an arrow assembly comprising an arrow shaft and a fletching device as described herein.

According to a further aspect of the present invention, there is provided an arrow shaft and a kit comprising a fletching device as described herein.

Non-limiting embodiments of the invention will now be described with reference to the accompanying drawings, in which;

FIGS. 1*a* and 1*b* show a side view and a perspective view of a straight fletching according to the prior art.

Figure 2A:
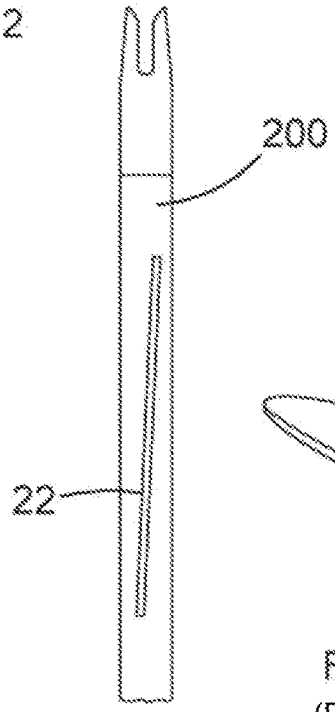
FIG.2a (Prior Art)
Figure 2B:
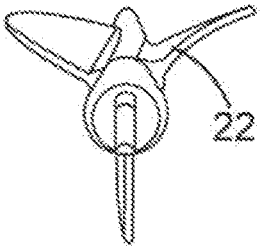
FIG.2b (Prior Art)
Figure 3A:
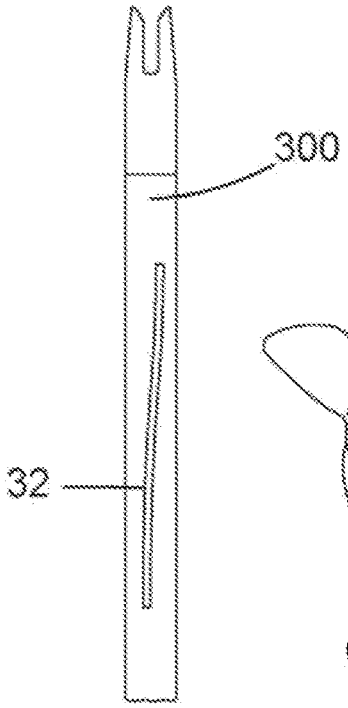
FIG.3a (Prior Art)
Figure 3B:
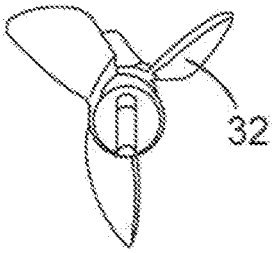
FIG.3b (Prior Art)

FIGS. 2*a* and 2*b* show a side view and a perspective view of an offset fletching according to the prior art.

FIGS. 3*a* and 3*b* show a side view and a perspective view of a helical fletching according to the prior art.

Figure 6A:
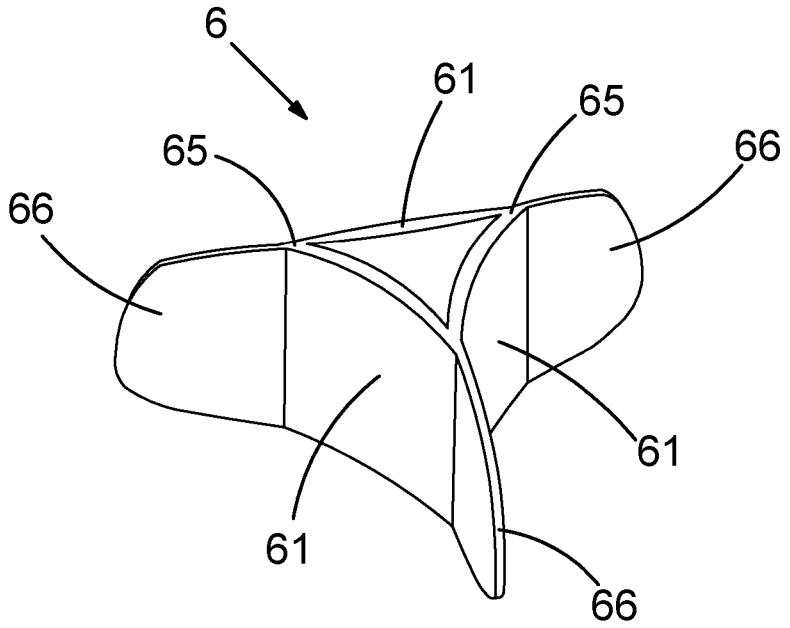
Figure 6B:
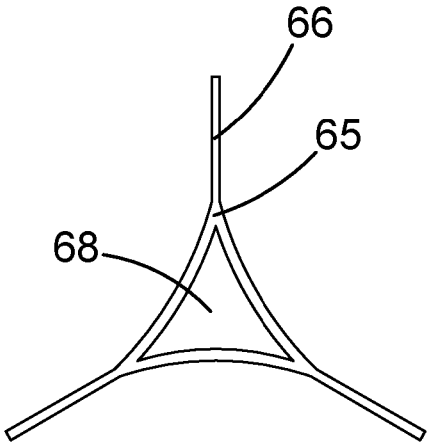
Figure 6C:
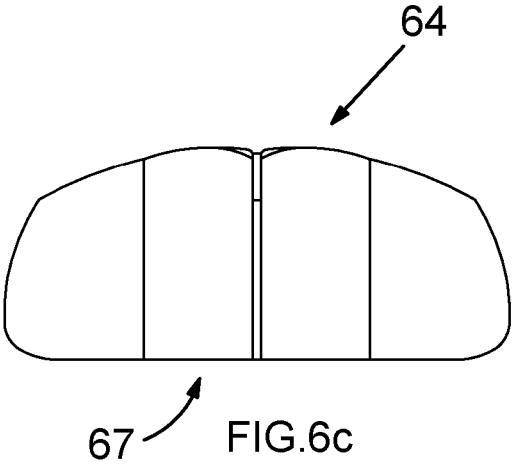
Figure 7A:
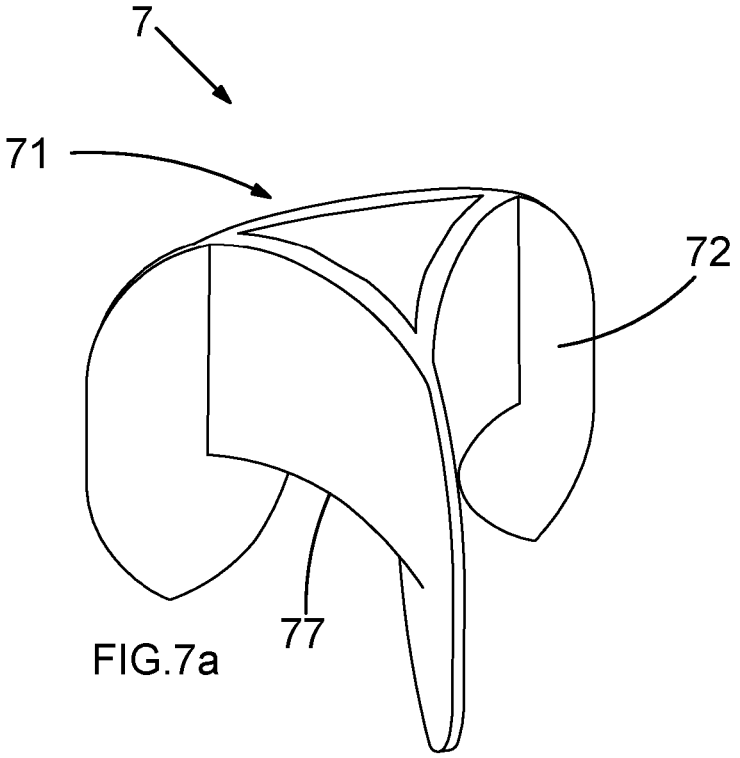
Figure 7B:
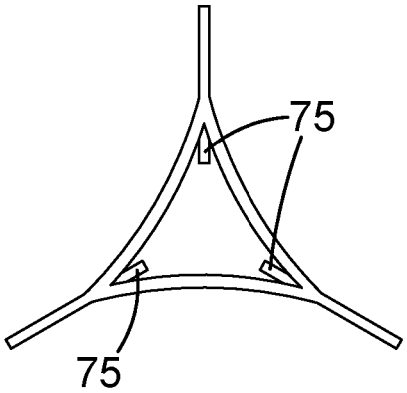
Figure 7C:
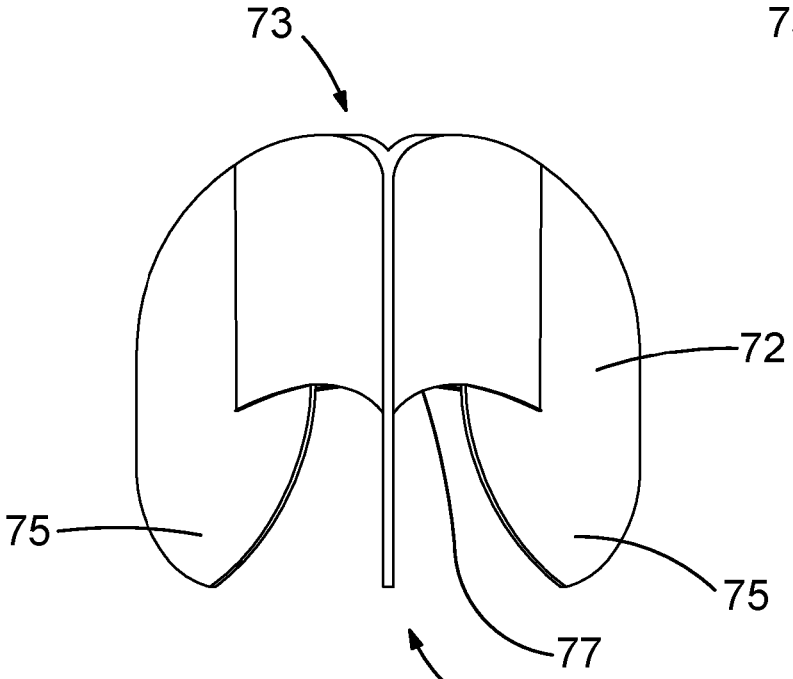
Figure 8A:
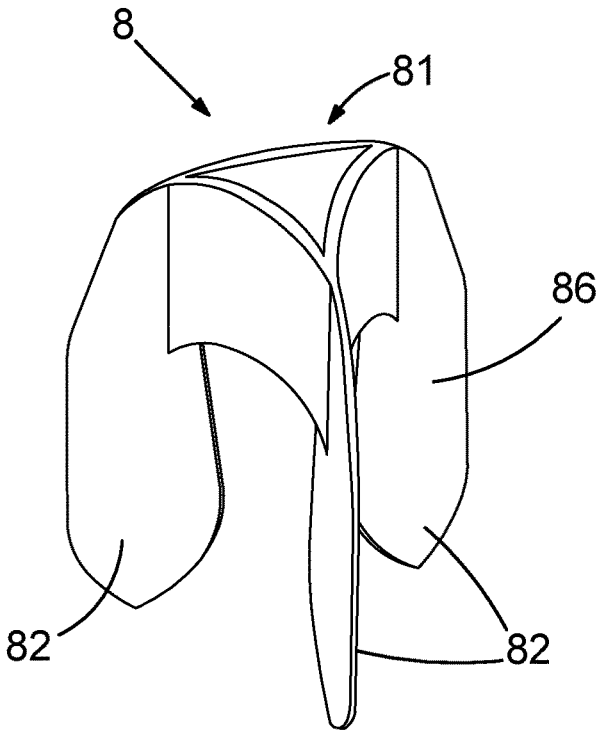
Figure 8B:
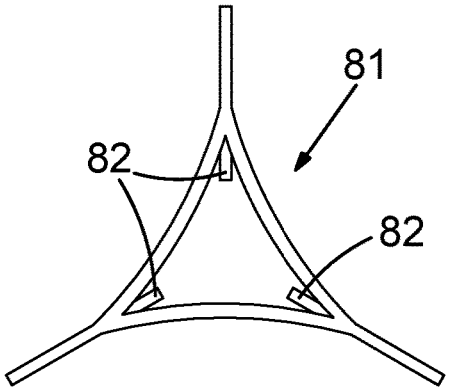
Figure 8C:
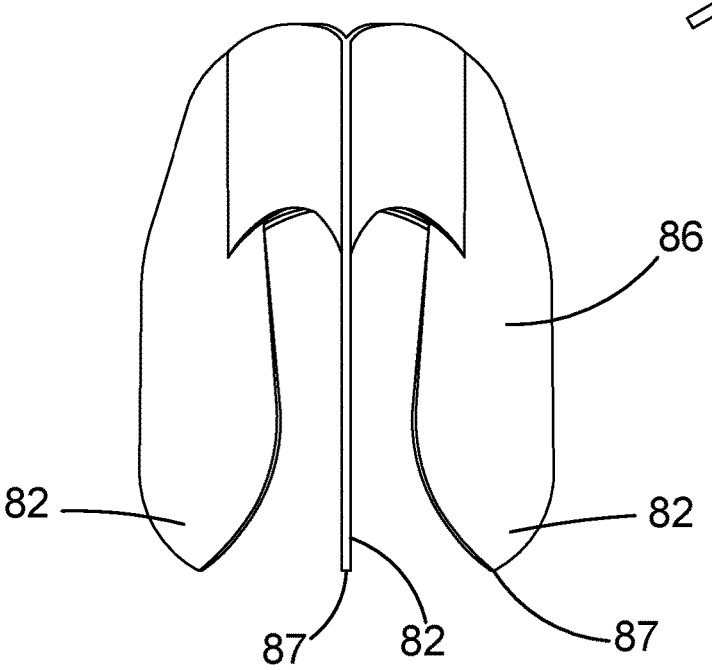
Figure 9A:
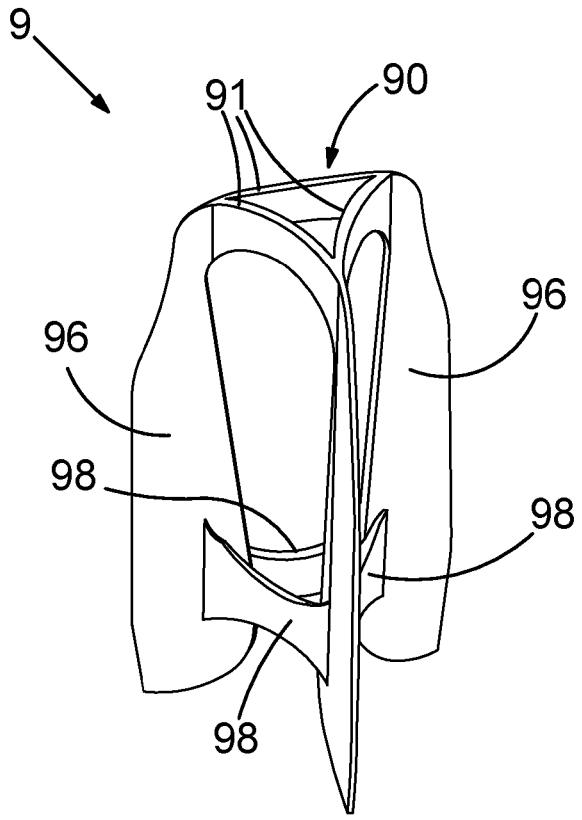
Figure 9B:
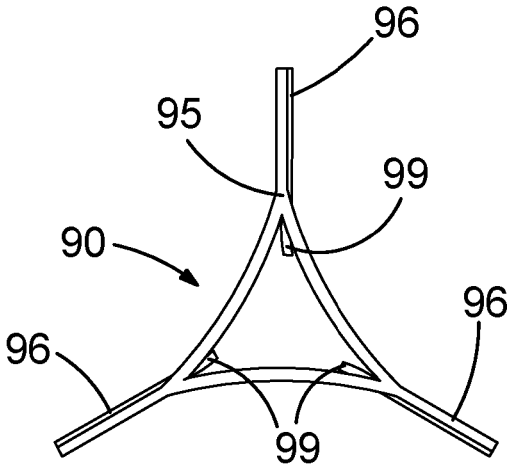
Figure 9C:
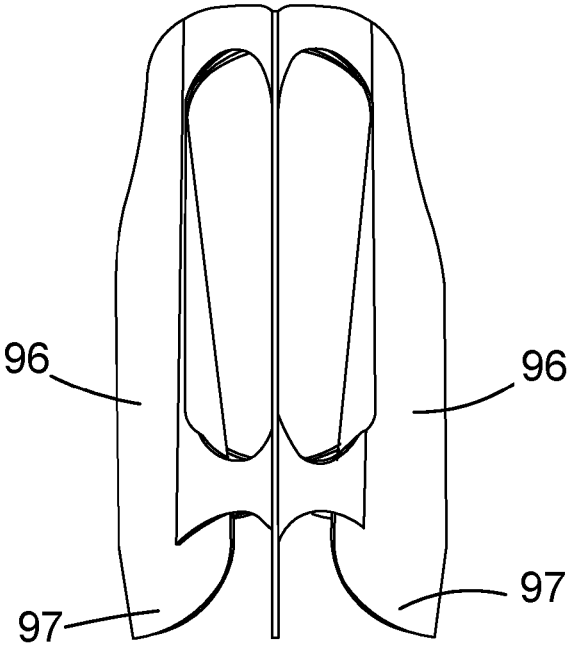

FIGS. 4*a*-4*f* show plan views of embodiments of fletching devices according to the invention;

FIGS. 5*a-j* schematically show side views of vanes that can be used with, or part of, fletching devices according to the invention;

FIGS. 6*a*-6*c* respectively show a perspective view, a front view and a side view of an embodiment of the fletching device according to the invention;

FIGS. 7*a*-7*c* respectively show a perspective view, a front view and a side view of an embodiment of the fletching device according to the invention;

FIGS. 8*a*-8*c* respectively show a perspective view, a front view and a side view of an embodiment of the fletching device according to the invention;

FIGS. 9*a*-9*c* respectively show a perspective view, a front view and a side view of an embodiment of the fletching device according to the invention.

Figure 10A:
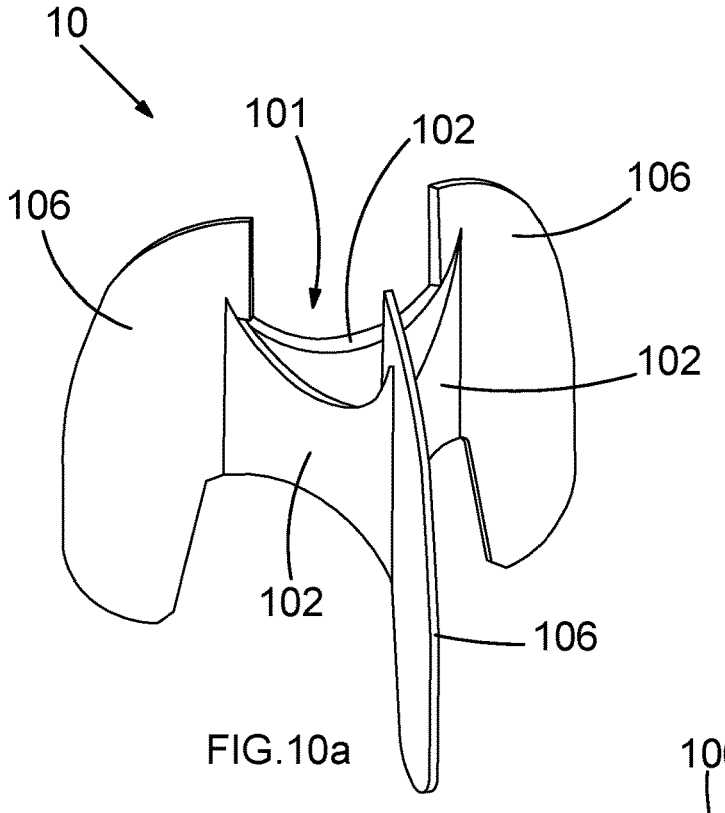
Figure 10B:
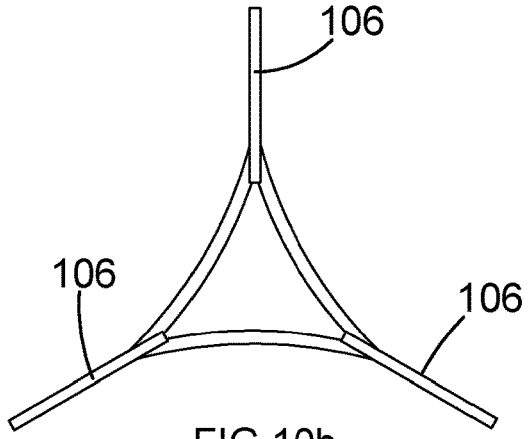
Figure 10C:
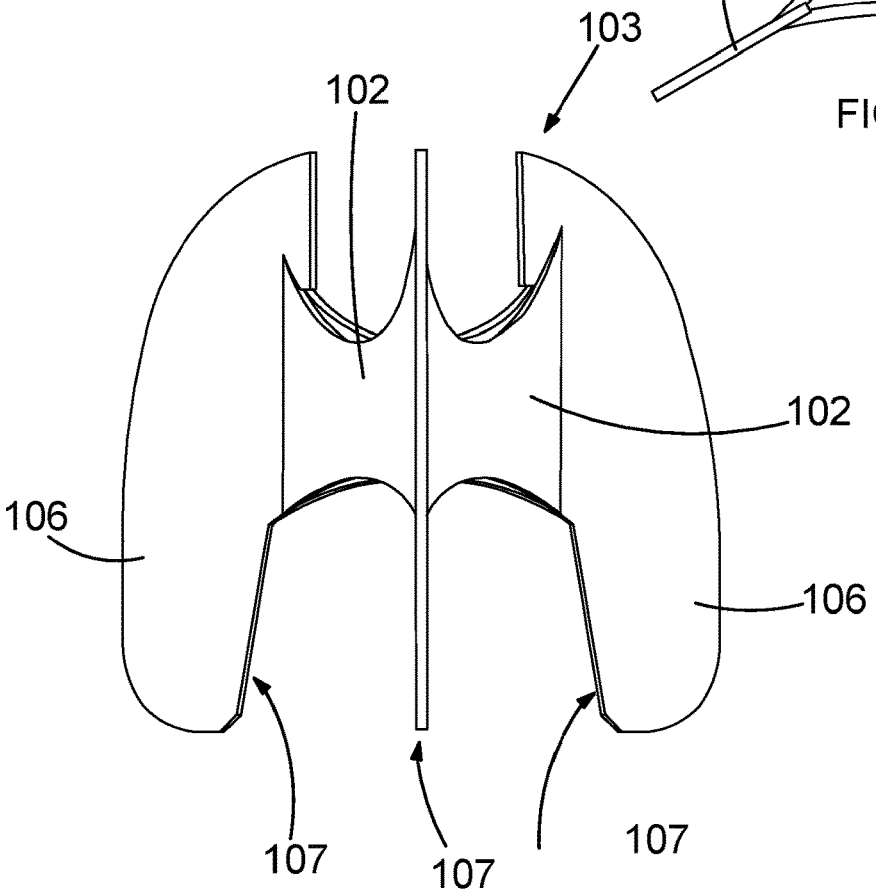
Figure 11A:
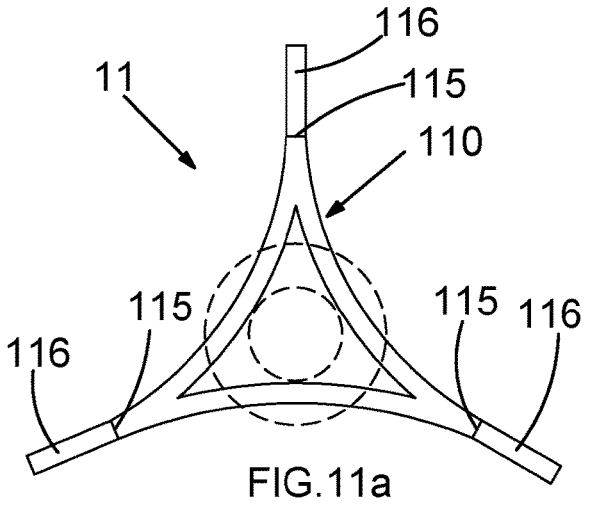
Figure 11D:
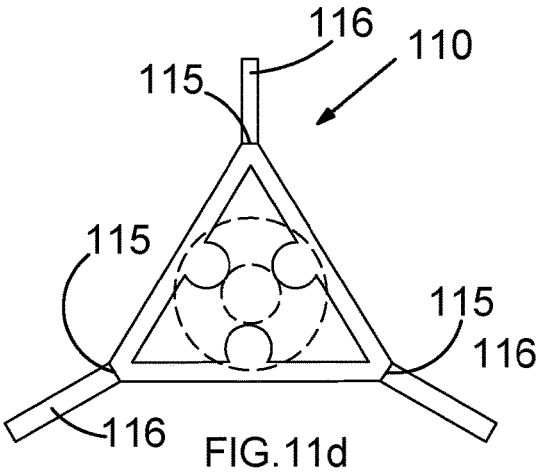
Figure 11B:
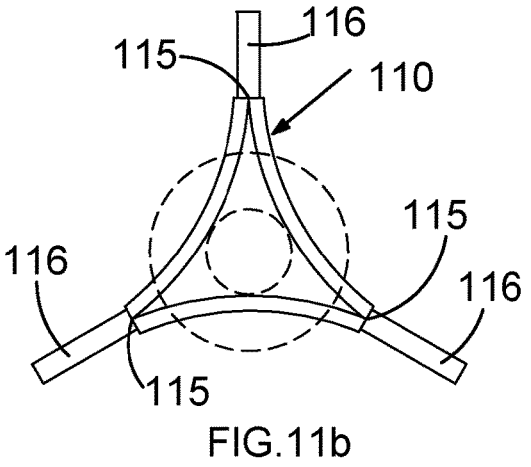
Figure 11E:
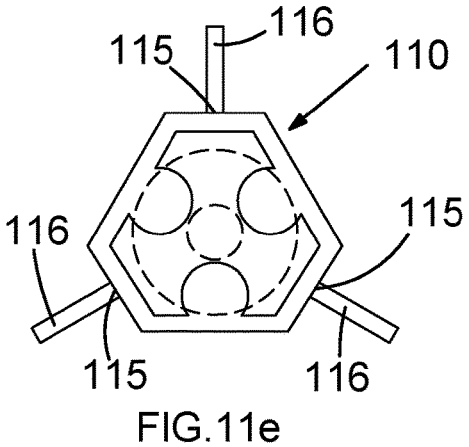
Figure 11C:
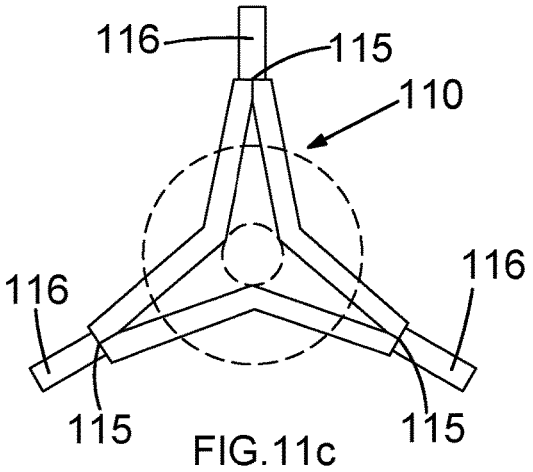
Figure 11F:
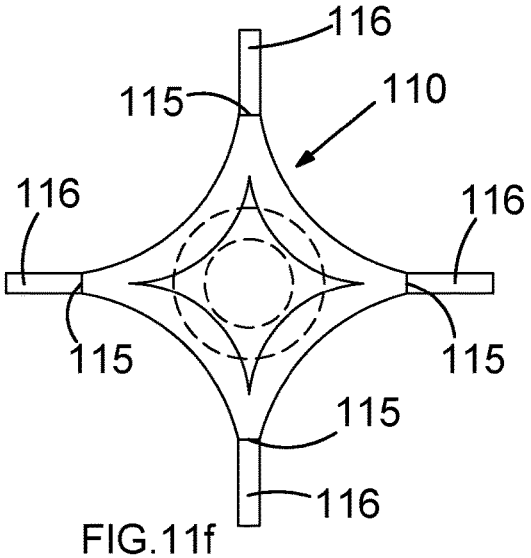

FIGS. 10*a*-10*c* respectively show a perspective view, a front view and a side view of an embodiment of the fletching device according to the invention.

Figure 12A:
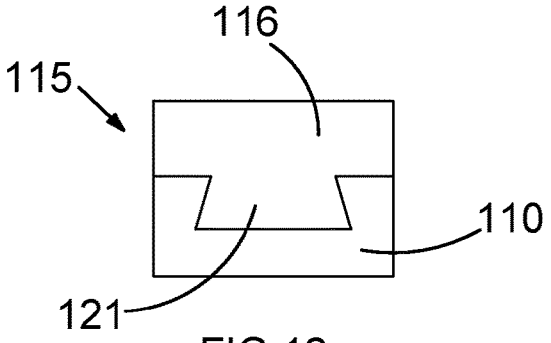
Figure 12B:
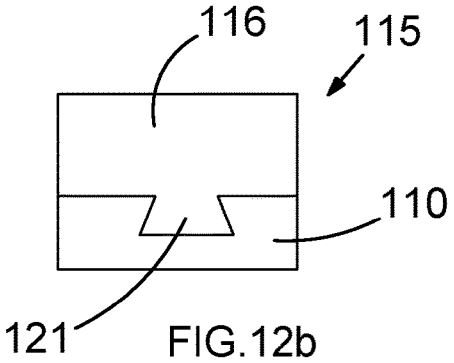
Figure 13A:
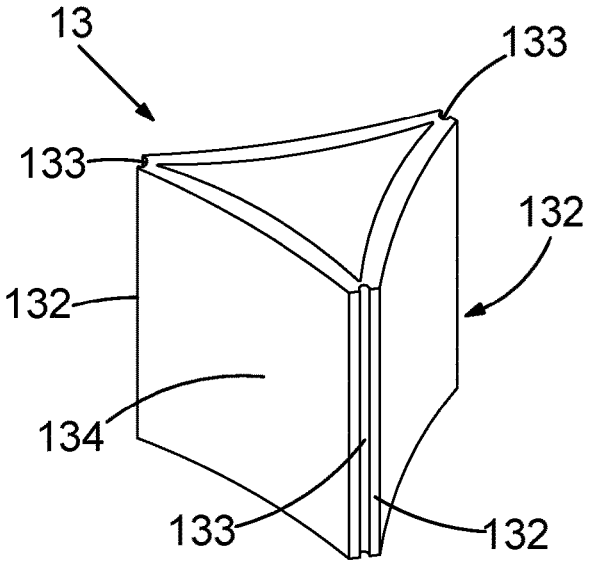
Figure 13B:
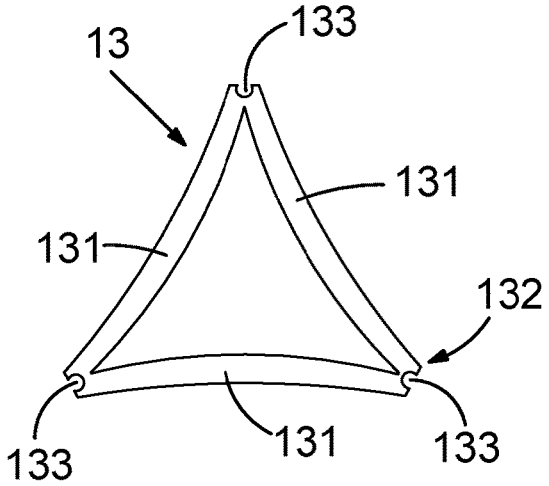
Figure 13C:
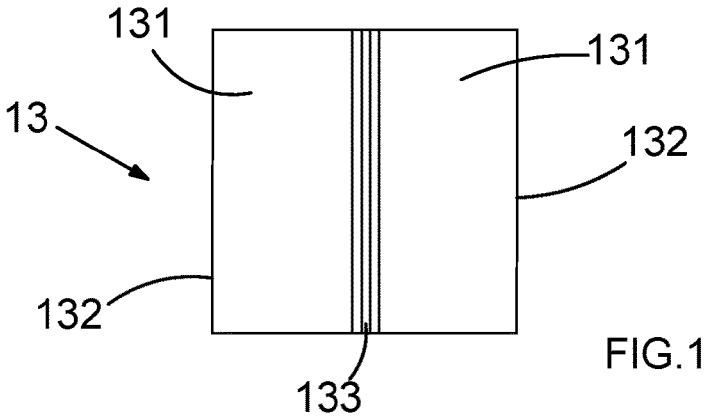

FIGS. 11*a*-11*f* schematically show plan views of embodiments of a kit comprising a fletching devices and vanes according to the invention;

FIGS. 12*a* and 12*b* schematically show front and rear cross sectional views of snap-fit couplings between vanes and a bodies of fletching devices according to embodiments of the invention;

FIGS. 13*a*-13*c* show perspective, plan and side views of an embodiment of a fletching device according to the invention.

FIGS. 4*a*-4*f* show plan views of fletching devices 4 according to different embodiments of the present invention.

FIG. 4 shows a device 4 which has a body 40 which is formed from three ribs 41 which are joined to each other at their end portions 42. The body is made of a deformable plastic, rubber or polymer. The ribs are bent to define an inner space 43 which is adapted to accommodate an arrow shaft. The inner space has a generally triangular shape when viewed from above and has three symmetry axes when viewed from above (as in FIG. 4). The sides of the triangle are curved inwardly and the interior angles of the triangle are less than 60°. The interior angles of the triangular shape are however all equal. The ribs 41 are pre-stressed. That is, they are under strain, even when the device is not attached to an arrow shaft. This strain can be achieved by manufacturing the device from three generally straight pieces of deformable plastic. The pieces are bent into the shapes shown in FIG. 4*a* and then joined at their ends to adjacent ribs. The pre-stressed nature of the ribs aids in providing the amount of friction between the body and the arrow shaft which is necessary to keep the body attached to the shaft of an arrow when the arrow undergoes acceleration as it is fired. The ribs 41 are reversibly deformable. At the three apexes where the ribs are joined together, vanes 47 extend radially outwardly from the body. These vanes provide the stability to the arrow during flight. The vanes 47 are permanently affixed to the body 40 and are not removable from the body.

In use, an arrow shaft is inserted, generally point first, into the space 43. The device is slid to the rear end of the arrow shaft. The dotted lines show the boundaries of the range of arrow diameters with which the device is compatible. The dotted line 44 shows the lower bound. Arrows must have a diameter greater than the diameter of the line 44 to be compatible. The line 45 shows the largest diameter which is compatible. As the device is slid onto the arrow shaft, the arrow shaft contacts the inner walls of the ribs 41 at the three points 46. Because the diameter of the arrow is larger than the dotted line 44, the ribs 41 are deformed outwardly in the directions shown by the arrows A. This deformation means that the ribs exert a frictional force on the arrow shaft through the contact points 46. This frictional force ensures that the fletching device does not fall off the arrow shaft when it undergoes the high accelerations involved in shooting the arrow.

The body 40 can be quickly removed from an arrow shaft simply by overcoming the frictional forces holding it in place, to slide the device off an end of the arrow. Glue may also be used to provide a permanent attachment. In this case, the device still has the advantage of being fast and consistent to attach to the arrow shaft, and adjust, prior to the application of the glue.

The larger the arrow shaft, the more the ribs 41 will be outwardly deformed in the directions of the arrows marked A. Since the ribs are deformable the device can accommodate arrows of different diameters, up to the diameter shown by the dotted line 45.

When the device is engaged with an arrow shaft, each pair of adjoined ribs 41 define an air channel 48 in the inner space 43. Three air channels are therefore provided. These air channels run parallel to a longitudinal axis of the arrow shaft. As the arrow flies through the air, air flow through these air channels creates a venturi effect and assists in stabilizing the arrow.

Figure 4A:
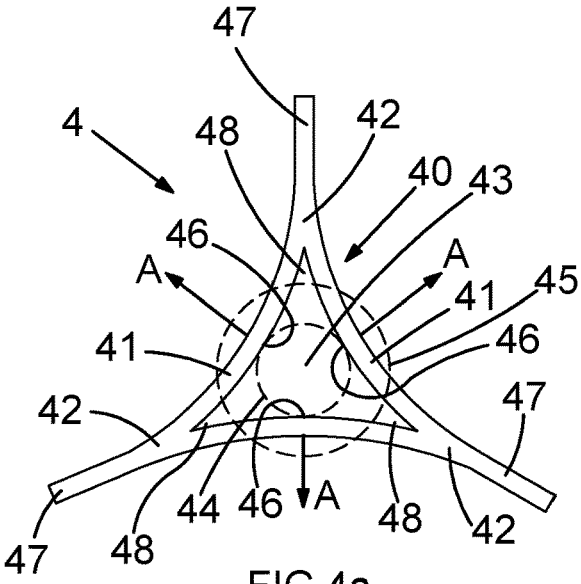
Figure 4D:
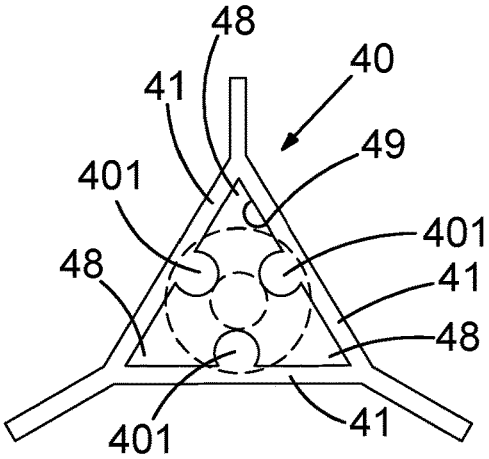
Figure 4B:
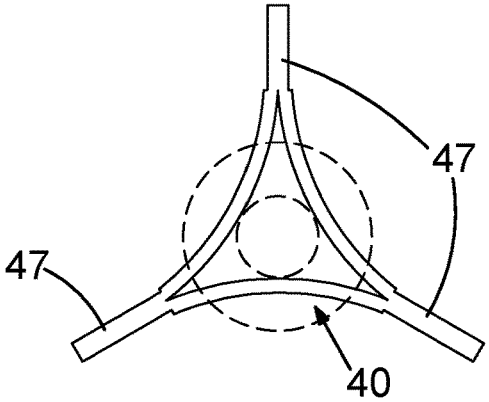

FIGS. 4*b*-4*f* show different embodiments of fletching devices which are similar to the fletching device illustrated in FIG. 4*a*. The body 40 in FIG. 4*b* has generally the same construction as the body in the FIG. 4*a*. The vanes 47 in FIG. 4*b* are however thinner, relative to the corners of the body to which they are attached, than the vanes 47 shown in FIG. 4*a*. The vanes 47 in FIG. 4*b* are also permanently affixed to the body 40.

Figure 4E:
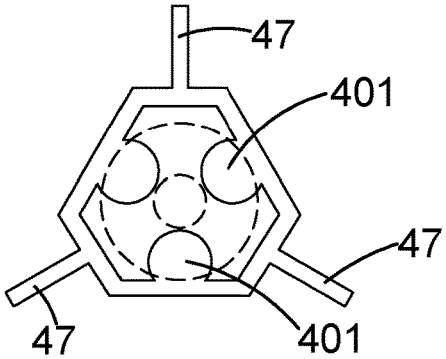
Figure 4C:
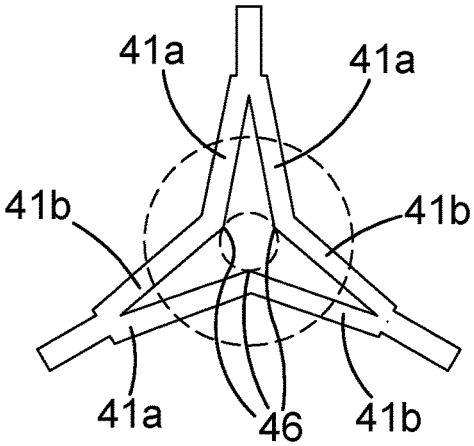

In FIG. 4*c*, the fletching device 4 is similar to the one illustrated in FIG. 4*b*. According to this embodiment, each rib 41, instead of being curved, comprises two planar portions 41*a* and 41*b* which are of equal length and which are angled with respect to each other creating an inwardly directed contact point 46. The contact points 46 come into contact with the arrow shaft 400 and provide the friction fit between the body 40 and the arrow shaft.

FIG. 4*d* shows a fletching device 4 with a body 40 having three straight ribs 41, each provided with a spherical protrusion 401 which extending inwardly from inner surfaces 49 of the body. The straight ribs are not pre-stressed (under strain) when the device is not engaged with an arrow shaft. The spherical protrusions 401 are located half way along the lengths of the ribs 41. The spherical protrusions 401 provide contact points which are adapted to provide the friction fit between the body 40 and an arrow shaft. The straight nature of the ribs provides a larger air channels 48. This can improve the stability of the arrow when the device is engaged with an arrow shaft.

FIG. 4*e* shows a fletching device 4 with a body 40 having six planar ribs 41 arranged in a generally hexagonal shape. Three ribs 41 are provided with spherical protrusions 401 extending inwardly. Three of the ribs 41 provided with spherical protrusions 401. These ribs are adjacent to a rib which does not have a spherical protrusion. The fletching device is provided with three vanes 47 and the vanes are coupled to the ribs 41 without protrusions 401. Further, in contrast to the other embodiments, the vanes 46 are coupled to the ribs 41 at their mid points.

Figure 4F:
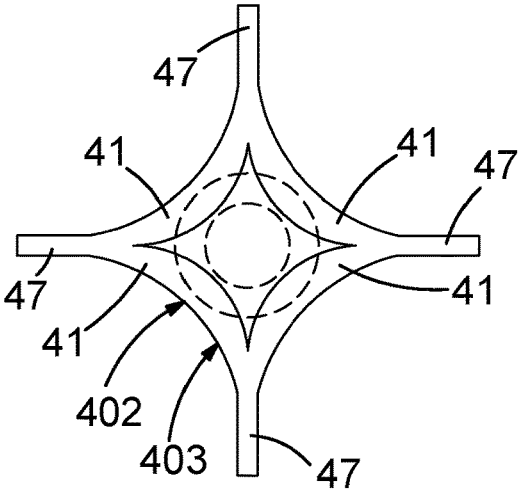

FIG. 4*f* shows a fletching device with a body 40 having four ribs 41 and 4 vanes 47, arranged in symmetrically. The ribs 41 are curved inwards when the fletching device is not mounted on an arrow shaft. Each elastically deformable rib 41 has a cross-section which has a non-constant thickness. In particular, a middle section 402 of each rib 41 has a thickness which is greater than the end portions of each rib 403. The varying thickness of the ribs improves the deformability and the ability of the ribs to provide an appropriate friction force when the device is engaged with arrows having different diameters. The fletching device 4 is provided with four vanes 46. The device has four-fold symmetry when viewed from above.

FIG. 5 shows vane shapes which may form part of the invention, when viewed from the side. The vanes 51 are mounted on the body 52 of the device, a portion of which is shown. Any of these vane shapes are compatible with any of the embodiments shown in FIGS. 4*a*-4*f*.

Figure 5A:
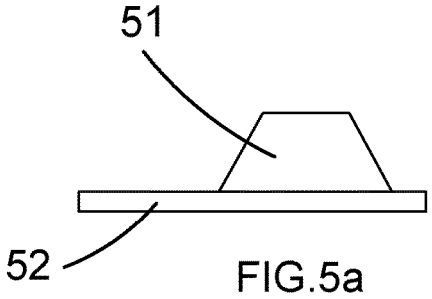
Figure 5B:
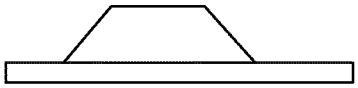
Figure 5C:
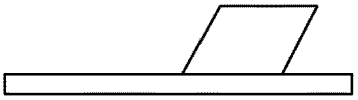
Figure 5D:
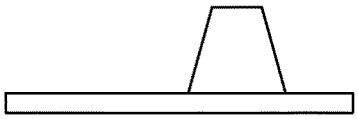
Figure 5E:
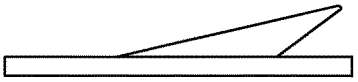
Figure 5F:
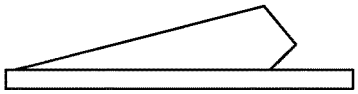
Figure 5G:
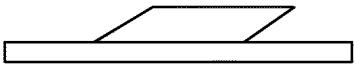
Figure 5H:
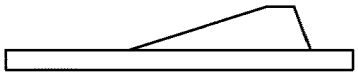
Figure 5I:
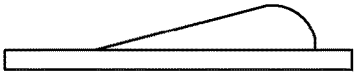
Figure 5J:
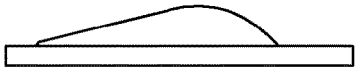
Figure 5K:
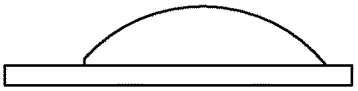
Figure 5L:
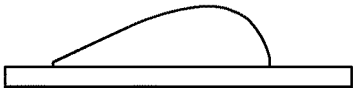

Vanes 51 can have a parallelogram shape, as illustrated in FIG. 5*c* or 5*g*, have a triangular or rhomboid shape, as illustrated in FIGS. 5*e* and 5*f*. Vanes can also have a semi-circular or otherwise curved profile as illustrated in FIGS. 5*i*-*j*. The vanes may be symmetric with respect to a plane which is perpendicular to a longitudinal axis of the body. This is shown in FIGS. 5*a*, 5*b*, 5*d* and 5*i*.

FIGS. 6*a*-6*c* show a fletching device 6 according to one embodiment of the present invention. The body 60 is provided with three inwardly curved ribs 61. End portions 65 of adjacent ribs 61 overlap and are joined together. Vanes 66 extend radially outwards from the body 60. The ends of the vanes are curved when viewed from the side as shown in FIG. 6*c*, and are slightly raked back to define a front end 64 and a back end 67 of the device. The space 68 has generally the same shape as the space 43 shown in FIG. 4*a*.

FIGS. 7*a*-7*c*, show another fletching device 7 according to another embodiment of the present invention. The structure of the body is generally the same as the embodiment shown in FIGS. 6*a*-6*c*. The body 71 and the vanes 72 are generally raked back so that the device has a rounded front end 73 and a back end 74. At the back end, the vanes 72 extend beyond the end of the body 71. Further, rear portions 75 of the vanes 72 extend beyond the longitudinal extension of the body 71 of the fletching device. The rear portions 75 protrude radially inwardly towards a central longitudinal axis of the body. This is most easily shown in FIG. 7*b*. When mounted on an arrow shaft, the rear portions can overhang the rear end of the arrow shaft. This can improve air flow and stability of the arrow. The rear edges of the body 77 are curved.

FIGS. 8*a*-8*c* show a fletching device 8 which is similar to the fletching device illustrated in FIGS. 7*a*-7*c*. According to this embodiment, the vanes 86 have a more elongated teardrop shape. The rear portions 82 of the vanes protrude inwardly towards a central longitudinal axis of the body 81. This is shown in FIG. 8*b*. The rear of the teardrop vanes 86 form points 87. The device of FIGS. 8*a*-8*c* is made from a stiffer material than the device shown in FIGS. 6*a*-6*c*. This reduces the amount by which the overhanging vanes 82 in FIGS. 8*a*-8*c* move as the arrow flies through the air.

FIGS. 9*a*-9*c* show a fletching device 9 comprising a body 90 provided with three inwardly curved ribs 91 at a first front end of the device. End portions 95 of adjacent ribs 91 overlap and from each end portion a vane 96 extends radially outwardly from the body 90. The vanes 96 extend at their rear ends beyond the longitudinal extension of the body 90. The portion 97 of the vanes 96 which extends beyond the longitudinal extension of the body of the fletching device protrudes radially inwards towards the longitudinal axis of the body 90. The fletching device 9 is provided with a further three ribs 98 near to the rear of the device. The ribs 98 bridge the portions 97 of the vanes which extend inwardly towards the longitudinal axis of the body. The ribs 98 are more rigid and are less resiliently deformable than the ribs 91. The ribs 98 therefore strengthen the vanes 96. The ribs 98 also aid in providing a helical left or right-orientated fletching as they provide a solid base from which the vanes may be offset. In use, when the device is engaged with an arrow, the device can be slid onto the arrow shaft until the inner edges 99 of the portions 97 of the vanes 96 contact the shaft. The portions 97 can therefore assist in providing a friction fit to the arrow and stabilize the engagement of the device with the arrow.

FIGS. 10*a*-10*c* show a fletching device 10 comprising a body 101 having three inwardly curved ribs 102. According to this embodiment, the vanes 106 extend in both the forward and rear directions beyond the longitudinal extension of the body 101 of the fletching device 10. FIG. 10*b* shows the device when viewed from above, looking at the forward face 103 of the device. The rear portions 107 of the vanes 106 are flared outwardly from the body.

FIGS. 11*a*-11*f* show kits according to the invention. The kits 11 are made up of a fletching device 110 and either three (FIGS. 11*a*-11*e*) or four (FIG. 11*f*) vanes 116. The fletching devices 110 are identical to the embodiments illustrated in FIGS. 4*a*-4*f*, except for the fact that the vanes are detachable from the respective bodies. The bodies 110 are provided with mounting means 115 which are adapted to removably couple vanes to the body. This allows a user to quickly remove a broken vane and replace it with a new one.

FIGS. 12*a*-12*b* show two cross sectional views of a mounting means 115. This mounting means may be used with any of the embodiments shown in FIGS. 11*a*-11*f*. At the apex between two ribs or on the face of a rib, the body 110 of the fletching device is provided with a tapered groove 121. Each groove 121 is shaped so that a corresponding interlocking portion of a vane 116 can snap-fit into the groove 121. The cross sections are taken at different heights, when looking down on the device, in the orientations shown in FIGS. 11*a*-11*f*. FIG. 12*a* is taken at a cross section which is nearer to the front edge of the device than the cross section shown in FIG. 12*b*. From these cross sections, it can be seen that the width of the groove 121 decreases as it gets nearer to the rear of the device. This is useful because the forwards acceleration of the arrow as it leaves the bow will tend to drive the tapered interlocking portion 116 of the vane deeper into the groove 121. The vane is therefore less likely to be dislodged by the by the acceleration.

FIGS. 13*a*-13*c* show a fletching device 13 according to one embodiment of the present invention. The shape and friction fitting of the body to an arrow shaft is generally as described in connection with FIGS. 4*a* and 11*a*. The device is provided with three mounting means 133 along the apexes 132 of the three ribs 131. According to this embodiment, the mounting means 133 are grooves which extend along the whole length of the body 134. The cross section of the grooves are generally semi-circular, such that a corresponding projection on a vane can be pushed into the groove and snap-fitted into the groove. This provides a fast and reliable means of consistently and reliably mounting replacement vanes in a fletching device.

The invention claimed is:

1. A fletching device which is removably mountable on an arrow shaft, the fletching device comprising:

a body which is engageable with an arrow shaft, and at least two vanes attached to the body, wherein the body is reversibly deformable such that a friction fit is provided between the body and an arrow shaft when the body is engaged with an arrow shaft, wherein the body is provided with at least two adjoined ribs which define an air channel when the body is engaged with an arrow shaft, and wherein the two adjoined ribs form at least two discrete contact points and are reversibly deformable to provide the friction fit between the body and the arrow shaft.

2. A fletching device according to claim 1, wherein the body is removably mountable on at least two different arrow shaft diameters, preferably the shaft diameters are 4.5 mm to 9.3 mm.

3. A fletching device according to claim 1, wherein the body is slidably mountable on the arrow shaft.

4. A fletching device according to claim 1, wherein one of the at least two discrete contact points is formed by a protrusion which extends inwardly from an inner surface of the body.

5. A fletching device according to claim 1, wherein the at least two ribs define more than two air channels when the body is engaged with an arrow shaft.

6. A fletching device according to claim 1, wherein a cross-section of the fletching device with respect to a longitudinal axis of the body has a rotational symmetry of order 3.

7. A fletching device according to claim 1, wherein the at least two vanes have profiles which are symmetric with respect to a plane perpendicular to their lengths.

8. A fletching device according to claim 1, wherein at least one of the at least two vanes is offset with respect to a longitudinal axis of the body.

9. A fletching device according to claim 1, wherein at least one of the at least two vanes has an helical shape.

10. A fletching device according to claim 1, wherein the body comprises a deformable material selected from a polymer, a rubber or a carbon fiber reinforced polymer.

11. An arrow assembly comprising an arrow shaft and a fletching device according to claim 1.

* * * * *